United States Patent [19]

Absenger et al.

[11] Patent Number: 4,658,791

[45] Date of Patent: Apr. 21, 1987

[54] MULTI-CYLINDER FUEL INJECTED INTERNAL COMBUSTION ENGINE

[75] Inventors: Erich Absenger, Passau; Hans A. Kochanowski, Ruhstorf, both of Fed. Rep. of Germany

[73] Assignee: Motorenfabrik Hatz GmbH & Co. KG, Ruhstorf, Fed. Rep. of Germany

[21] Appl. No.: 721,528

[22] Filed: Apr. 9, 1985

[30] Foreign Application Priority Data

Apr. 18, 1984 [DE] Fed. Rep. of Germany ..... 3414797
Oct. 11, 1984 [DE] Fed. Rep. of Germany ..... 3437284
Jan. 21, 1985 [DE] Fed. Rep. of Germany ..... 3501784

[51] Int. Cl.[4] ..... F02M 41/02
[52] U.S. Cl. ..... 123/446; 123/459
[58] Field of Search ..... 123/446, 459, 514, 299, 123/300, 501, 502, 187.5 R

[56] References Cited

U.S. PATENT DOCUMENTS

| | | | |
|---|---|---|---|
| 2,177,020 | 10/1939 | Fuscaldo | 123/65 R |
| 2,821,183 | 1/1958 | Roosa | 123/187.5 R |
| 3,465,733 | 9/1969 | Thornber | 123/446 |
| 4,092,964 | 6/1978 | Hofer et al. | 123/459 |
| 4,289,098 | 9/1981 | Norberg et al. | 123/300 |
| 4,425,885 | 1/1984 | Tanaka et al. | 123/446 |
| 4,437,443 | 3/1984 | Hofbauer | 123/446 |
| 4,528,951 | 7/1985 | Yamada | 123/446 |

FOREIGN PATENT DOCUMENTS

| | | | |
|---|---|---|---|
| 233327 | 5/1964 | Austria . | |
| 723590 | 8/1942 | Fed. Rep. of Germany . | |
| 2343203 | 3/1974 | Fed. Rep. of Germany . | |
| 3141547 | 5/1983 | Fed. Rep. of Germany | 123/446 |
| 671428 | 12/1929 | France . | |
| 818197 | 8/1959 | United Kingdom . | |

*Primary Examiner*—Willis R. Wolfe, Jr.
*Attorney, Agent, or Firm*—Flynn, Thiel, Boutell & Tanis

[57] ABSTRACT

A multi-cylinder fuel injection engine has a respective fuel injector nozzle associated with each cylinder and has one injector pump which supplies fuel to all of the nozzles. The engine includes a rotatable drive element having a plurality of cams which correspond in number to the number of cylinders, which are uniformly angularly distributed thereon, and which successively act on a delivery element of the pump as the drive element is rotated. A shut-off member is associated with each injector nozzle and can close the fuel supply line to the nozzle's injection orifice, the shut-off member being controlled in dependence on a control criteria which determines the injection timing point. Fuel is thus supplied to all nozzles, but can only flow through a respective one of the nozzles which has its shut-off member moved in response to the control criteria to an open position.

19 Claims, 18 Drawing Figures

204
206
202b
202
224
208
220
210
206b
206a
208a
208b
222
216
212
218
214
120a
185
188
185a
184
192
190a
190
190c
170
190b
190d
166a
202a
226
200
190

MULTI-CYLINDER FUEL INJECTED INTERNAL COMBUSTION ENGINE

FIELD OF THE INVENTION

This invention relates to a multi-cylinder fuel injected internal combustion engine, and in particular to such an engine in which a fuel injector nozzle is associated with each cylinder and the fuel feed to each nozzle is effected by means of an injector pump driven by the engine through a drive element.

BACKGROUND OF THE INVENTION

In conventional internal combustion engines of this type, a separater injector pump is associated with each nozzle, and has its own delivery piston to provide the fuel feed. This arrangement is very wasteful and costly, because a separate pump and nozzle is necessary for each cylinder of the internal combustion engine. Furthermore, such an arrangement requires, apart from the considerable effort expended in its assembly, complicated and extensive servicing of the many parts.

SUMMARY OF THE INVENTION

It is an object of the present invention to overcome the disadvantages of this conventional arrangement. According to the invention, a single injector pump common to all injector nozzles of the engine is provided, and a delivery element of the pump is driven by a drive element of the engine having a plurality of drive cams which correspond in number to the number of cylinders and which are distributed uniformly in angular relation to one another. In addition, a shut-off member is associated with each injector nozzle and normally keeps the fuel supply line feeding the injector orifice of the nozzle closed, the shut-off member being movable to an open position facilitating fluid flow through the fuel supply line in dependence on a control criteria determining the injection timing point, so that fuel is delivered to all nozzles at the same time by the single pump but only flows through a respective one of the nozzles which has its shut-off member moved so as to open the fuel line therein in response to the corresponding control criteria.

According to a further feature of the invention, the control criteria can be based on one of several events occurring in the internal combustion engine at the injection timing point, such as the particular compression force in the operating chamber of the cylinder associated with the nozzle, or the inlet valve or both the inlet and exhaust valves being closed. Even the position, during the compression stroke, of the cylinder piston can serve as the control criteria, through mechanical or electronic sensing of such position.

BRIEF DESCRIPTION OF THE DRAWINGS

Several embodiments of the invention are explained in the following description with reference to the drawings, in which.

DETAILED DESCRIPTION

Figure 2:
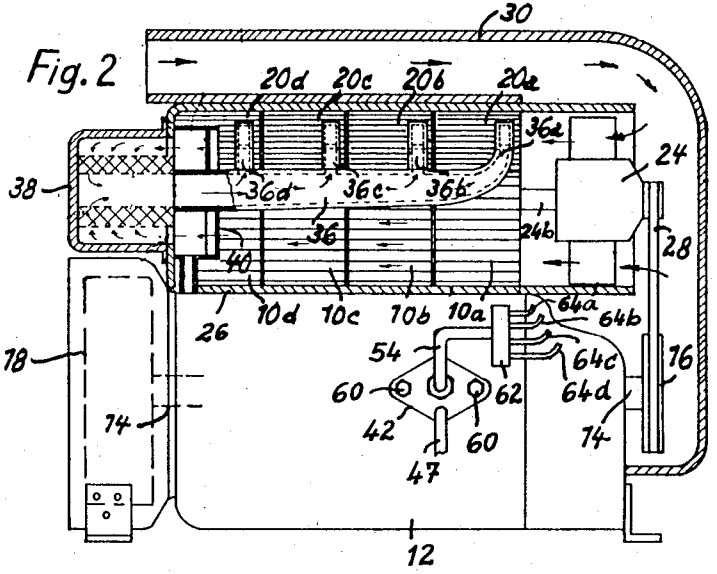
FIG. 2 is a side view, partly in section, of the engine of FIG. 1.
Figure 3:
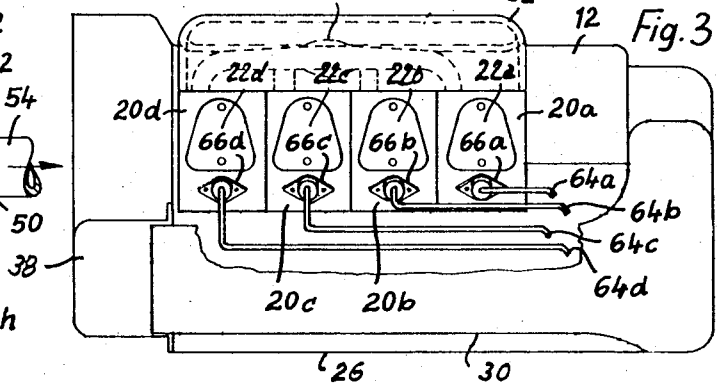
FIG. 3 is a fragmentary top view of the engine of FIG. 1.
Figure 1:
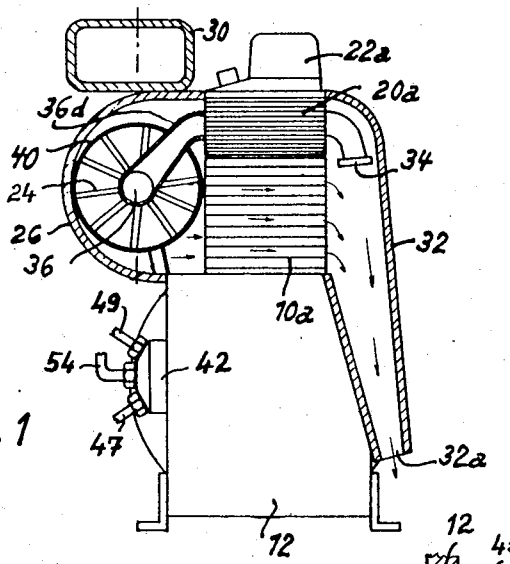
FIG. 1 is an end view, partly in section, of a fuel injected internal combustion engine equipped with an injection system embodying the invention.

FIGS. 1 to 3 show a four cylinder, air-cooled, four stroke, fuel injection internal combustion engine, the vertical cylinders **10*a*–10*d* of which are arranged in a row and are secured on a common crankcase 12, wherein the crankshaft 14, driven by the cylinder pistons, has on one end a V-belt pulley 16 and, on the other end, a flywheel 18. A respective cylinder head 20*a*–20*d* is fixed on each of the cylinders 10*a*–10*d*, and valves and associated control parts are arranged in each cylinder head. The components in the cylinder heads are accessible for servicing through removable cylinder head covers 22*a*–22*d*. The air necessary for cooling the engine is drawn in by a fan 24 in the direction of the arrows through an inlet pipe 30 and a cowling 26**.

The fan 24 is supported on a shaft **24*b* fixed on the first cylinder 10*a*, and is driven by the pulley 16 via the V-belt 28**.

The outlet side of the cooling air ducting system is designed as a flat outlet duct 32 which runs downwardly approximately parallel to the line of cylinders and causes the cooling air to be exhausted through the slot aperture **32*a* into the surrounding air. The exhaust pipes (not illustrated) of the individual cylinders are merged together into a single exhaust pipe 34 (FIG. 1), which empties into the duct 32**.

Within the cowling 26 is an inlet or suction pipe 36 having four individual branches **36*a*–36*d* which lead to inlet ports in the cylinder heads 20*a*–20*d*. An air filter 38 is provided at the inlet end of the suction pipe 36. In addition, an impurity separator 40, for example a cyclone separator having vaned walls which produce a swirling effect, is arranged concentrically to the suction pipe 36**.

Figure 4:
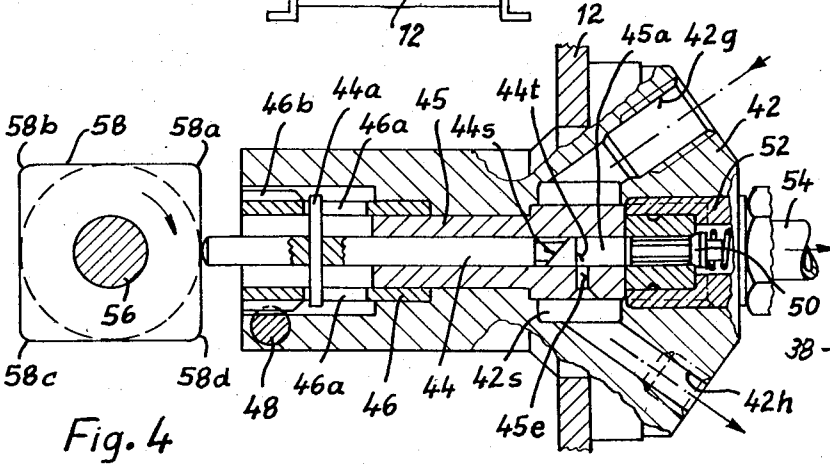
FIG. 4 is a longitudinal sectional view of an injector pump of the engine of FIG. 1, which pump is equipped with a delivery piston driven by the engine.

FIG. 4 shows a conventional fuel injection pump 42 in a somewhat larger scale than it is shown in FIGS. 1 and 2. Its delivery piston 44 is axially slidable in a piston sleeve 45 and is capable of being rotated around its longitudinal axis by means of a control sleeve 46. A carrier pin 44*a* secured in the piston 44 slides in a longitudinal slot 46*a* of the control sleeve 46. A control rod 48 operable by the operator meshes with circumferential teeth 46*b* provided on the control sleeve 46 and serves to rotate the components 44 and 46 during the metering of fuel. The piston 44 has a control edge 44*s* and an end face 44*t* which works in a conventional manner in conjunction with an inlet port 45*e* in the piston sleeve 45, which in turn leads to an operating chamber 45*a* of the piston 44, for controlling the quantity of fuel metered. A tapped port 42*g* facilitates connection of a suction pipe 47 (FIG. 1) to the pump 42, which pipe 47 is connected by a delivery pump to a fuel tank and enables fuel to be fed to the suction chambers 42*s* of the pump 42. A further tapped port 42*h* is provided and is used to connect to the pump 42 a return pipe 49 (FIG. 1), which returns surplus and unused fuel back to the fuel tank. A spring-loaded pressure valve 50 is provided within a pressure line union connection 52, which connects a pressure line 54 to the pump 42, and valve 50 controls fluid communication between the line 50 and piston operating chamber 45*a*.

The injection pump 42 is driven by a suitable component of the internal combustion engine. In particular, a rotatably driven drive shaft 56 for the pump 42 extends parallel to the crankshaft and carries a drive element 58 having four drive cams 58*a*–58*d* distributed uniformly in angular relation to each other, the cams acting successively on the projecting end of the delivery piston 44 as element 58 rotates. (It is conventional practice to cause these cams to operate on the delivery piston of the pump through an intermediate component equipped with a roller. For the sake of simplicity and clarity, this conventional intermediate component has been omitted).

The pump 42 is secured to the outer casing of the crankcase 12 with the aid of fixing screws 60 (FIG. 2) so that its delivery piston 44 comes into contact with the cams 58*a*–58*d* on drive element 58 within the crankcase 12. The pressure line 54 leads to a distribution component 62 to which four connecting lines 64*a*–64*d* are connected. Each of these connecting lines leads to one of the four injector nozzles 66*a*–66*d*, each of which is fixed to the outer casing of a respective cylinder head in a conventional manner by fixing screws so that its end having an injector orifice 74*a* projects into the operating chamber of the cylinder, as depicted in FIG. 5.

Figure 5:
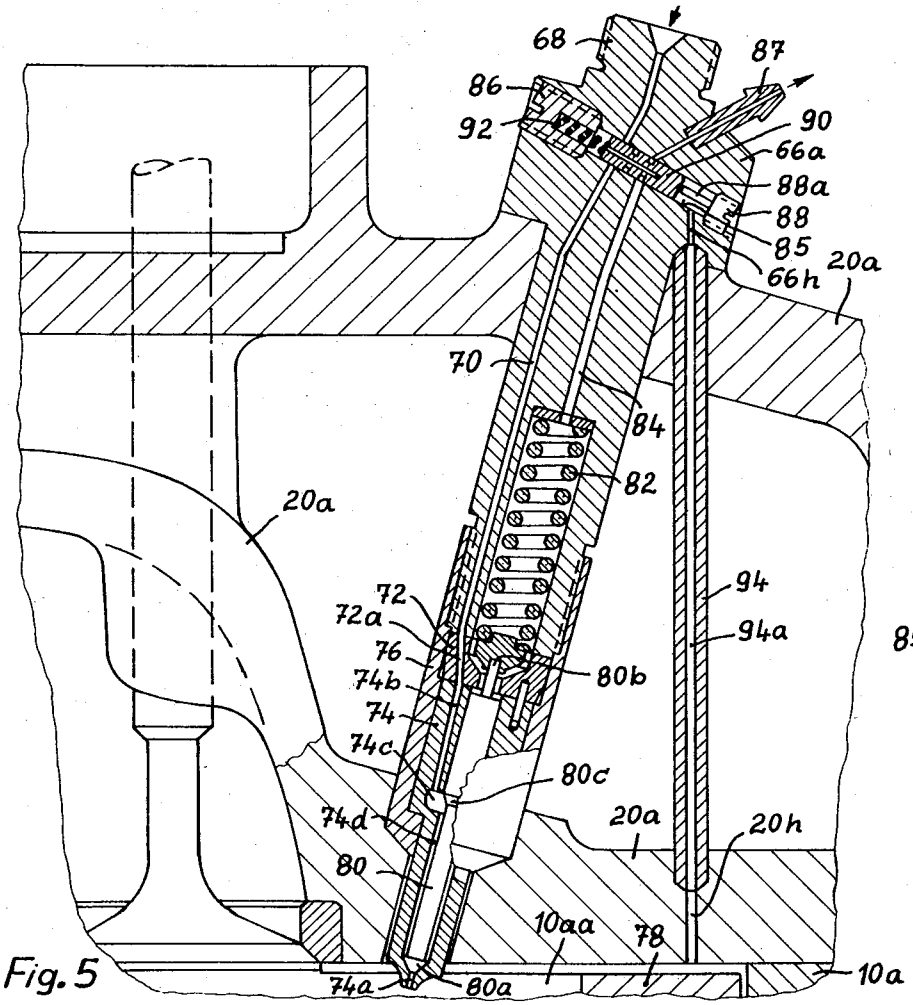
FIG. 5 is a fragmentary sectional view of part of the engine of FIG. 1, showing an injector nozzle which is controlled by the cylinder compression force and is housed in the cylinder head.

Each of the injector nozzles is identical, and nozzle 66*a* in FIG. 5 has a union nipple 68 for the associated connecting line 64*a* and has a longitudinal bore 70. The connecting line 64*a* is coupled by means of a union nut (not shown) to the nipple 68. Two intermediate components 72 and 74 are retained in the inside of the nozzle by means of a sleeve 76 screwed to the nozzle body, and the end of the sleeve 74 which projects into the operating chamber 10*aa* of the cylinder 10*a* has at least one injector orifice 74*a* which is directed toward an operating piston 78 which is movably supported in the cylinder 10*a*. A control member or jet needle 80 is movable within the sleeve 74, is provided with a conical needle point 80*a* on the end thereof facing the injector orifice 74*a* and can close this injector orifice, while its other end 80*b* is biased by a closing spring 82. When fuel under a very high pressure arrives in the annular void 74*c* of the sleeve 74 via passageways 70, 72*a* and 74*b* and acts upon a shoulder 80*c* of the jet needle 80, the needle is lifted upwardly from its annular seat at orifice 74*a* against the urging of closing spring 82, and fuel is injected through the injector orifice 74*a* into the operating chamber 10*aa*.

A transverse through-hole 85 is provided in the nozzle body 66*a* and is sealed with two threaded plugs 86 and 88. Within this hole 85 is a slidable control or blocking piston 90, which serves as a shut-off member and is urged by a return spring 92 into a closed or stop position engaging a stop pin 88*a* provided on the part 88. The control piston 90 is provided with two axially spaced circumferential grooves 90*a* and 90*b* (shown in FIGS. 6 and 7 in an enlarged scale), and has an axially extending overflow collector hole 90*c* which is connected by a transverse or radial hole 90*d* with the circumferential groove 90*b*.

Figure 6:
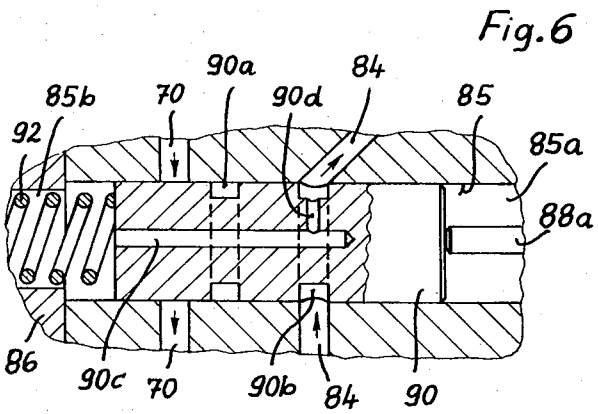
FIGS. 6 and 7 each show in an enlarged scale a portion of the structure of FIG. 5 in two different operating positions.

In FIGS. 5 and 6, the control piston 90 is shown in a position blocking the flow of fuel through the pressure passageway or line 70. A small amount of fuel can, however, flow by leakage to the hole 84, and then through the hole 84 to the return flow nipple 87. A small amount of fuel can also flow by leakage to chamber 85*b* and from there via the holes 90*c* and 90*d* to the groove 90*b*, and then through the hole 84 and the return flow nipple 87. However, when the control piston 90 is moved to the left in FIG. 7 by a pressure in the chamber 85*a* which exceeds the force of the spring 92, until it reaches the stop defined by the end face of the threaded plug 86, fuel flow through the pressure line 70 to the injector orifice 74*a* is facilitated by means of groove 90*a*. The leakage flow of fuel through the line 84 to the nipple 87 is interrupted.

For a four stroke internal combustion engine of the aforementioned type, injection of the fuel necessary for ignition is carried out in the conventional sequence 1-3-4-2 where the cylinders are numbered one after the other in the direction of the crankshaft axis. In the case illustrated, the firing sequence is therefore: 10*a*-10*c*-10*d*-10*b* (during two revolutions of the crankshaft 14, or in other words distributed over a crankshaft angle of rotation of 720°). In this sequence, the injector nozzles must each be timely operated for injecting the fuel into the associated cylinder, or in other words in the sequence 66*a*-66*c*-66*d*-66*b*. The injection pump 42 is pulsed four times in succession by the cams 58*a* to 58*d* during one revolution of the drive shaft 56, so that between the crankshaft 14 and the drive shaft 56 there has to be a speed reduction of 2:1 to ensure that, during two revolutions of the crankshaft and thus one cycle of the engine, four successive injection periods are defined for sequentially supplying fuel to each of the four cylinders through the associated injector nozzles 66*a*–66*d*.

This is effected in a manner so that the injection pump 42 is pulsed four times in succession by the drive cams 58*a*–58*d* during a single revolution of the drive shaft 56, and during this total period, all injector nozzles successively carry out one injection each. The correct sequence for the injector nozzles is established therefore by the fact that the control pistons 90 in the respective nozzles are moved in sequence and at the appropriate time to facilitate fuel flow through the supply line 70 leading to the injector orifice in each nozzle. In other words, each piston 90 is moved just before the associated piston 78 reaches its top dead center (TDC) position.

For the internal combustion engine in FIGS. 1–3, the control for operating the control pistons 90 is the compression force in the associated one of the operating chambers 10*aa*–10*dd*. In particular, as soon as each operating piston 78, during its compression stroke, produces in its operating chamber a pressure sufficient for fuel injection, this pressure is also present, via passageways 20*h*, 94*a* and 66*h*, in the associated chamber 85*a* and moves the control piston 90 therein from its position blocking the supply line 70 (FIG. 6) to its position (FIG. 7) facilitating fuel flow through the line 70.

The injection system in accordance with the invention therefore operates so that the injector pump 42 is caused to pump four times in each engine cycle and simultaneously pumps fuel to all injector nozzles 66*a*–66*d*, but so that the control piston 90 of only one respective nozzle is moved each time the pump 42 is pulsed, each nozzle being actuated when the associated operating piston is in its compression stroke and has produced a pressure sufficient to move the nozzle's control piston 90.

It is obvious that the injection system according to the invention can only be used effectively when only one cylinder at a time reaches the compression necessary for controlling the associated injector nozzle. In using the injection system of the invention on internal combustion engines having more than four cylinders, one might have to use two or more such systems.

An arrangement is shown in FIGS. 8 to 11 in which the injector nozzle is controlled with the aid of a sensor device in response to a valve position in order to determine the injection timing point. The injector nozzle 166*a* used in this case corresponds in its general construction and arrangement to the injector nozzle 66*a* in FIG. 5, and the internal combustion engine corresponds in its structure and design to the engine in FIGS. 1–3, so that a detailed description thereof is unnecessary. The supply line of the nozzle is identified by reference numeral 170 and the overflow line by numeral 184. A transverse hole 185 is provided in the nozzle body and is sealed tightly at one end with a plug 188. A control piston 190 is arranged to slide in the hole 185, the piston having a circumferential groove 190*a* which functions in conjunction with the supply line 170. In addition, it has a leakage collector groove 190*b* which communicates with a cylindrical void 185*a* via holes 190*c* and 190*d* and thereby communicates with the leakage return line 184. A return spring 192 in the void 185*a* biases the control piston 190 and attempts to move it to the left in FIG. 8.

Inserted in a vertical wall of the cylinder head 120*a* of the internal combustion engine is a stationary bearing sleeve 200, in which is supported a follower pin 202 which is free to slide axially. The center axis of the follower pin 202 is coaxial with the center axis of the control piston 190, so that one end 202*a* of the follower pin can engage the end face of the control piston 190. The other end of the follower pin is designed as a bearing dish or plate 202*b*.

Two walls of the cylinder head 120*a* which lie laterally opposite each other fixedly support a bearing shaft 204 (FIG. 9), which is used as axle for two double-arm pivot levers 206 and 208. Each pivot lever has an arm 206*a* or 208*a* which engages the bearing dish 202*b* of the follower pin 202. A second arm 206*b* or 208*b* of each pivot lever carries an adjusting screw 210 which is in contact with the edge of a disc-like spring abutment 212 or 214 of a respective valve 216 or 218 (inlet or exhaust valve) of the engine. Both valves are moved in a conventional manner by rocker arms shown only in broken lines in FIG. 8, such that they can each be moved downwardly against the force of the closing spring and away from a valve seat, thus opening an inlet or outlet port for the cylinder operating chamber of the engine.

Figures 8, 9, 10, 11:
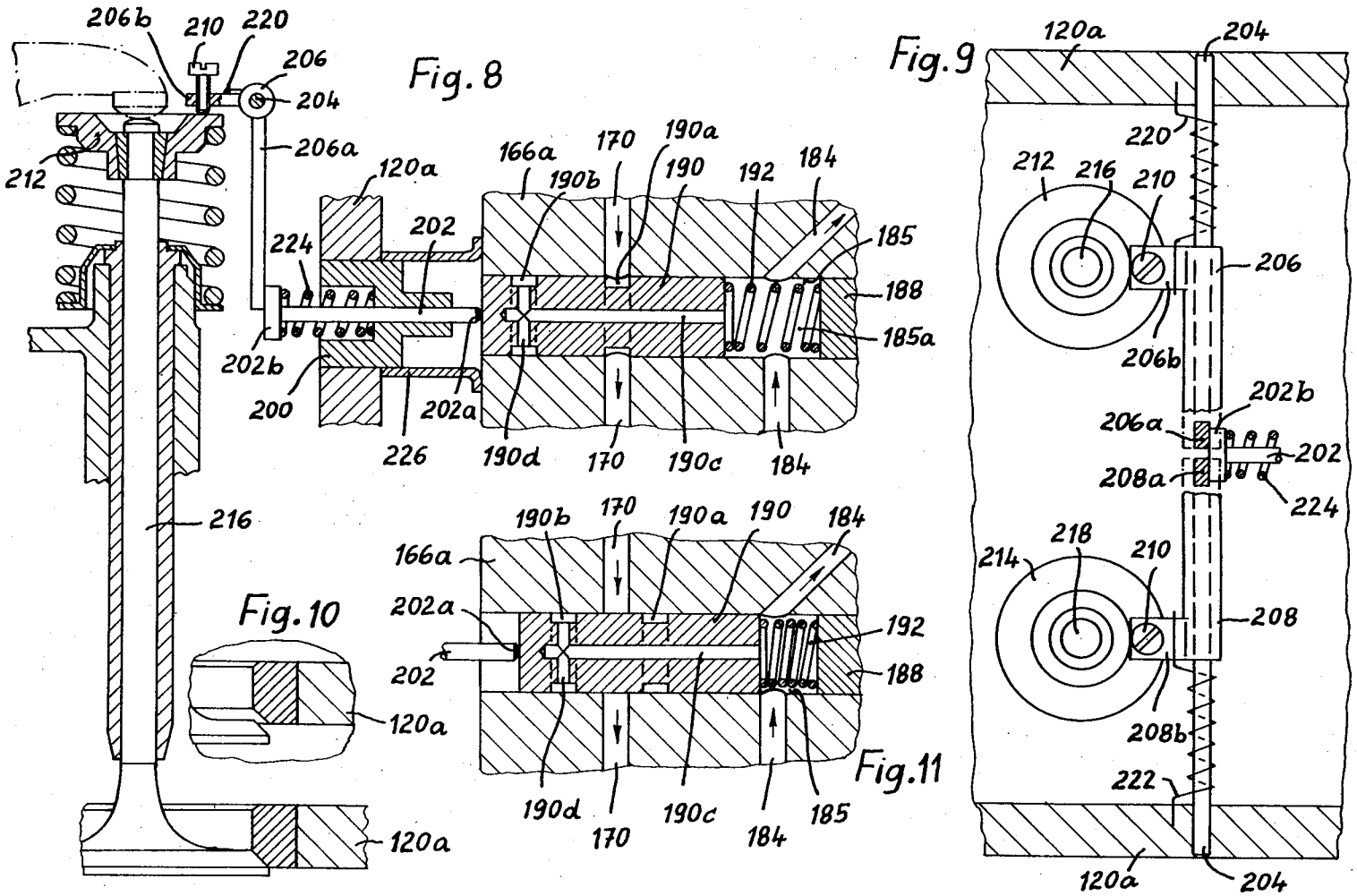
FIG. 8 is a fragmentary sectional view showing part of an alternative embodiment of FIG. 1, including an injector nozzle controlled by the position of an engine valve.
FIG. 9 is a fragmentary top view of the embodiment of FIG. 8.
FIG. 10 is a view of a portion of FIG. 8 showing a valve thereof in a different operational position.
FIG. 11 is a view of a portion of FIG. 8 showing a control element in the injection nozzle in an alternative operating position.

Each pivot lever 206 and 208 is biased by a spring 220 or 222 (FIG. 9) which is supported at one end on the cylinder head 120*a* and at the other end on the associated pivot lever 206 or 208, so that each pivot lever is urged in a clockwise direction in FIG. 8 and, as a result, presses its arm 206*a* or 208*a* against the bearing dish 202*b* of the follower pin 202, which is biased by a return spring 224, and so that each lever 206 and 208 presses its adjusting screw 210 against the respective valve spring abutment 212 or 214. Each of the springs 220 and 222 is powerful enough to overcome the combined forces of the corresponding springs 192 and 224.

A protective sleeve 226 made of rubber or a similar material surrounds the bearing sleeve 200 and the free end 202*a* of the follower pin 202, and thus protects the components 190 and 202 against dirt and damage.

When, in the course of the operating cycle of the engine, the inlet and outlet valves are both in the closed position (or are very close to being closed), the parts are in the operating position shown in FIG. 8. The control piston 190 is thus in the open position in which groove 190*a* is axially aligned with and facilitates fuel flow through supply line 170 of the nozzle 166*a* so that, during this open phase of the supply line 170 and at a correct injection timing point, fuel delivered by the injector pump (42 in FIGS. 1–3) is able to reach the nozzle injector orifices and is injected into the cylinder operating chamber. The same process repeats itself for the other injector nozzles in the sequence 166*a*, 166*c*, 166*d*, 166*b*, as explained in detail for the arrangement initially described.

However, as soon as one of the two valves associated with a given nozzle, for example valve 216, opens by moving away from its valve seat in a downward direction, then the associated pivot lever 206 is pivoted counterclockwise by its spring 224, which keeps the components 210 and 212 in contact. This results in the arm 206*a* of the pivot lever 206 engaging the bearing dish 202*b* and pressing the follower pin 202 to the right in FIG. 8, even though at this point in time the other valve 218 and its pivot arm 208 have remained stationary, or in other words have not been moved from the valve-closed position. The end 202*a* of the follower pin 202, during this movement of parts 216, 206 and 202, moves the control piston 190 rightwardly in FIG. 8 and brings it into the position shown in FIG. 11. In this position, the flow of fuel through the supply line 170 of the injector nozzle 166*a* is blocked by the control piston 190.

This alternate opening and closing of the supply line in the injector nozzle occurs at all four injector nozzles 166*a*–166*d* in sequence, so that by the action of the injector pump 42 with its four-pulse delivery action, all four operating cylinders are successively supplied with fuel in proper sequence.

It should be noted, with respect to the example in FIGS. 8–11, that it would be sufficient in some operating situations to mechanically sense only one valve, for example the inlet valve.

It may be further mentioned that, instead of the mechanical sensing of the valve operating position just described, fuel flow in the injector nozzle supply lines could be controlled by a sensing device equipped with electrical and/or electro-magnetic components. This could be achieved, for example, such that the inlet and outlet valves, when closed, each close an electrical contact in an electrical circuit and thus keep a solenoid energized, which in turn keeps a control piston (similar to piston 190) in the position permitting fuel flow through the nozzle fuel supply line. However, as soon as one of the contacts opens due to an opening of the associated valve, the electrical circuit is interrupted and the control piston is brought into the position blocking fuel flow by a return spring.

It would also be possible to sense the position of a component of the engine to determine the injection timing point (for example a connecting rod or piston) using electro-optical or electronic devices provided in an electrical circuit, and to utilize the actuation of this electrical circuit to control a component (similar to the control piston 90 shown in FIG. 5) which in turn controls the fuel flow through the injector nozzle. Finally, it should be noted that one can also employ the invention in an analogous manner for two-stroke fuel injection internal combustion engines.

Figure 7:
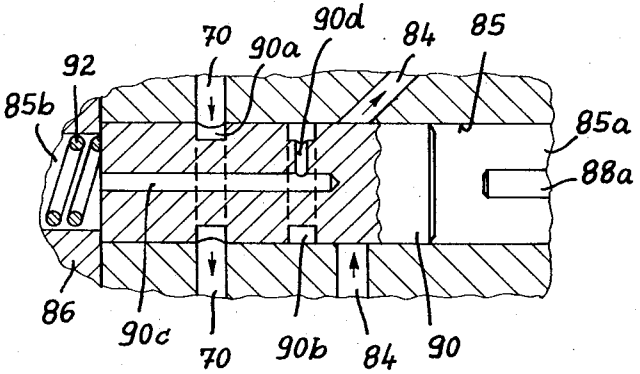
Figure 13:
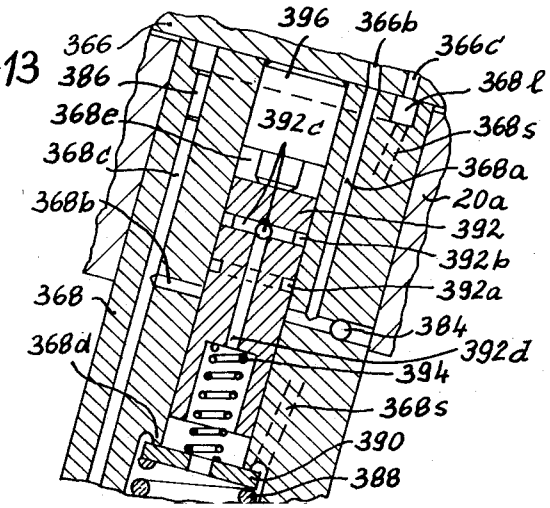
FIGS. 13 and 14 each show in an enlarged scale a portion of an injector nozzle of FIG. 12 in two different operating positions.
Figure 14:
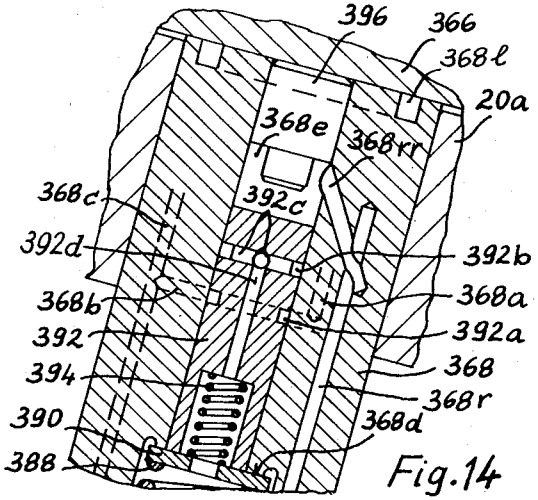
Figure 12:
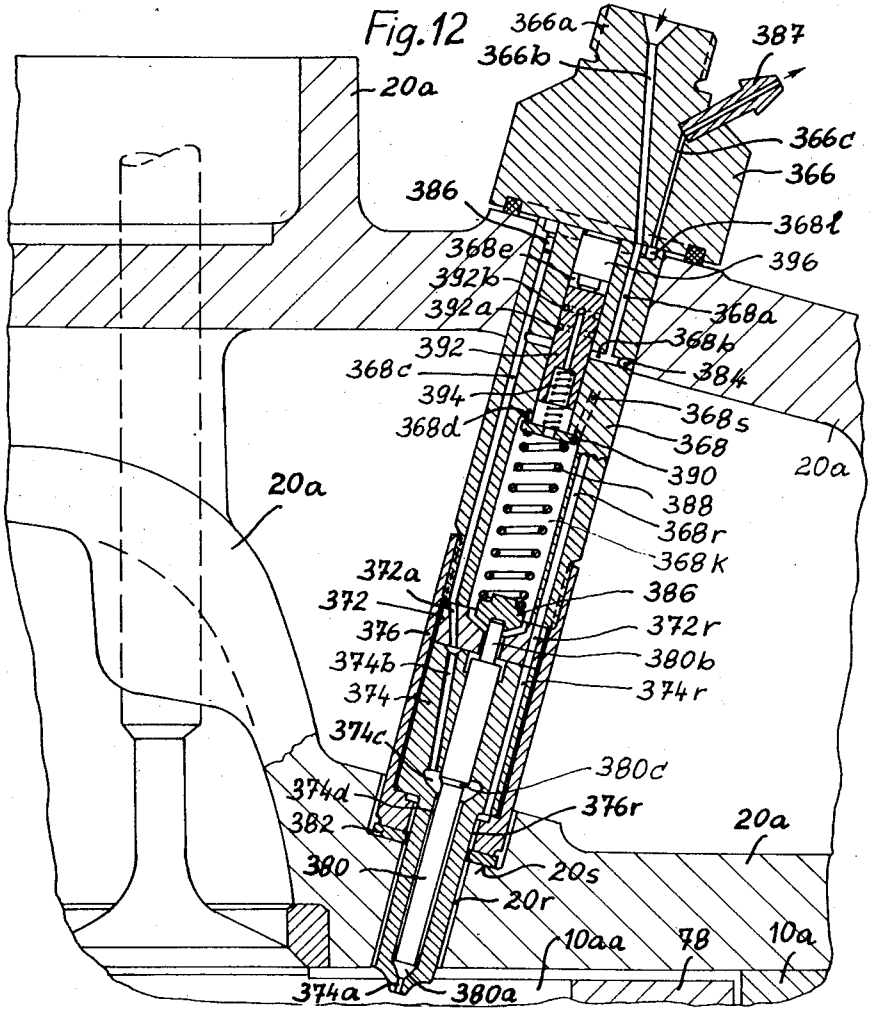
FIG. 12 is a fragmentary sectional view showing part of a further alternative embodiment of the engine of FIG. 1.

FIGS. 12 to 14 show an arrangement of a shut-off device in an injector nozzle which differs from the design shown in FIGS. 5 to 7. In this case, the injector nozzle is inserted in the engine block 20*a* as well. The individual parts 368, 372 and 374 are firmly secured to each other by means of the threaded sleeve 376 and are secured in their respective angular positions by a structure which is not shown, such as fixing pins. The connector piece 366 is locked in the necessary angular position in relation to the part 368 and is secured to the block 20*a* by fixing screws (not shown), the entire injector nozzle being pressed against a rigid seating face 20*s* of the block so that an end face of the part 376 lies against a spacer ring 382 which rests on the surface 20*s*. The fuel supply from the connector piece 366*a* is accomplished through an angled hole 366*b* to a deep bored hole 368*a* of the part 368, which in turn communicates with a transverse hole 368*b*. This transverse hole is sealed at one end by a sealing agent, in the present example a ball 384, and communicates at its other end with a hole 368*c*. The hole 368*c* is sealed off at one end by a pin 386, and at its other end communicates with an angled hole 372*a* in the part 372. A bored hole 374*b* in the part 374 carries the fuel into a pressure chamber 374*c*, where it can act upon a pressure surface 380*c* of a jet needle 380. When the jet needle is raised by this pressure, fuel flows through the annular bore 374*d* to the injector orifice 374*a* and is injected in the operating chamber 10*aa* of the cylinder 10*a* for the piston 78.

The jet needle 380 is biased at its end 380*b*, which has disc-like spring abutment 386, by a spring 388 which has its other end supported on another disc-like spring abutment 390 which is disposed against a seating face 368*d* of the part 368. A control piston 392 is arranged to slide in an axial bore 368*e* in the part 368 and is biased by a return spring 394 so that it normally engages a stop pin 396 securely fixed in the bore. The piston 392 has two annular grooves 392*a* and 392*b*. The annular groove 392*a* works in conjunction with the transverse hole 368*b*, while the annular groove 392*b* functions as a leakage collector, as explained later.

In the operating chamber 386*e* of the piston 392, a compression force to move piston 392 is produced by a series of ducts providing communication between the chamber 386*e* and the cylinder operating chamber 10*aa*. In particular, an annular channel 20*r* surrounds the end of the nozzle and communicates with an annular gap 376*r* between the parts 374 and 376, which in turn communicates via axial holes 374*r* and 372*r* with a deep bored hole 368*r* which, as shown in FIG. 14, communicates via an angled hole 368*rr* with the operating chamber 368*e* of the control piston 392.

The return of leakage fuel from the nozzle to the fuel tank occurs through a connecting nipple 387 which communicates through a hole 366*c* with an annular collector groove 368*l* on the end face of the part 368. An angled hole 368*s* (shown in broken lines in FIG. 13) connects the annular groove 368*l* with a chamber 368*k* in which the spring 388 is provided, leakage fuel collected by the annular groove 392*b* of the control piston 392 flowing into chamber 368*k* through holes 392*c* and 392*d* in the piston 392.

During the suction stroke of the cylinder piston 78, there is a small vacuum in the operating chamber 10*aa*, so that the control piston 392 is in the position depicted in FIGS. 12 and 13, in which fuel flow through the bore 386*b* is blocked by the piston 392. As a result, no fuel can be fed from the supply line 366*b* to the injector orifice 374*a*.

When the operating piston 78 carries out its compression stroke, the pressure increases in chamber 10*aa*, and thus the pressure in the operating chamber 368*e* of the control piston 392 also increases. At the injection timing point, the compression force is at such a pressure sufficient to overcome the force of return spring 394 and move the control piston 392 into the position illustrated in FIG. 14. The annular groove 392*a* now facilitates fuel flow through the channel 368*b*, so that fuel is fed through the hole 368*c* and fuel injection occurs through the injector orifice 374*a*.

It is obvious that the passage between the piston operating chamber 10*aa* and the operating chamber of the control piston 392 is provided within the injector nozzle itself, so that an external passage between these two operating chambers (as at 94 in FIG. 5) is not necessary. As a result, an expedient simplification in the construction of the overall nozzle is achieved.

It is known in fuel injection engines to carry out, a short time before the main fuel injection, a preinjection of a small amount of fuel into the same cylinder in order to ensure an easy starting of the combustion in the cylinder and thus to achieve a noticeable reduction in the noise level during operation of the engine. In injection systems of this type, an additional injection pump unit and an associated injection nozzle for the preinjection must normally be provided for each cylinder. In other words this means that, for example for a four cylinder engine, preinjection requires a total of eight pumps and eight nozzles, which in turn means excessive structure and expense and is thus particularly disadvantageous.

In the embodiment according to FIGS. 15 to 18, this disadvantage is avoided, in that the aforedescribed injection system is used for the main injection and, in addition to the injection pump which is needed for the main injection, a further injection pump is provided for the preinjection and conveys fuel to the injection nozzles, which are each used for preinjection and for the main injection and are each equipped with a control piston.

Figure 17:
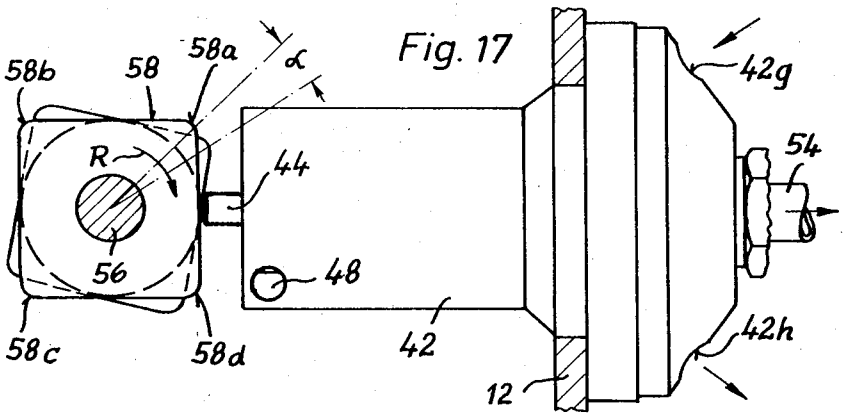
FIGS. 17 and 18 are fragmentary views of different portions of the engine of FIG. 15, and respectively show a main fuel pump and a preinjection fuel pump, along with associated components.
Figure 18:
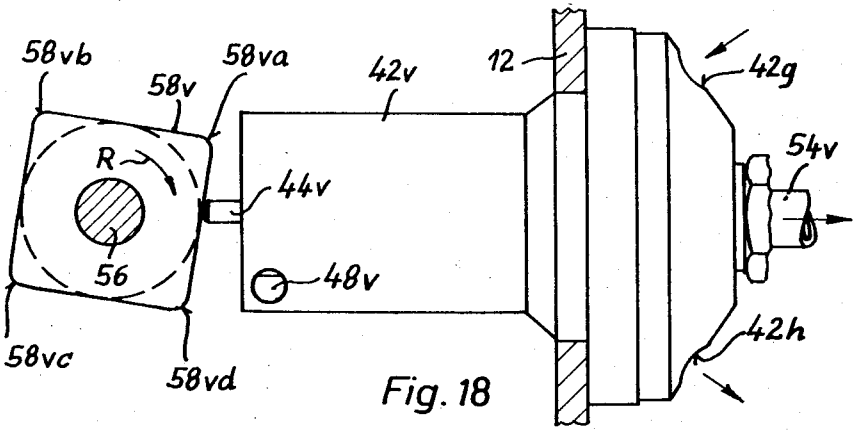
Figure 15:
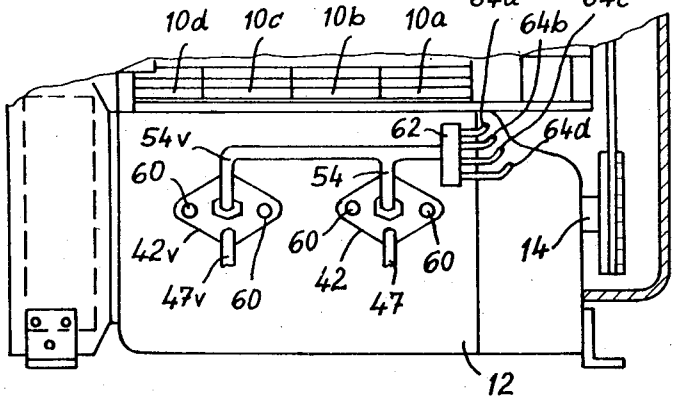
FIG. 15 is a fragmentary side view of another alternative embodiment of the engine of FIG. 1.

The main injection pump 42 is secured by means of screws 60 on the housing 12 of the internal combustion engine, as illustrated in FIG. 15. Its suction or input line, which can be connected thereto at 42g, is identified with reference numeral 47, its pressure or output line with 54 and its connecting thread for an overflow line with 42h (FIG. 17). The four cylinders of the machine are identified with numerals 10a, 10b, 10c, 10d. The pump 42 is utilized for the main injection of the fuel.

In addition to the pump 42 there is mounted on the housing 12 a further pump 42v (FIGS. 15 and 18) which is used for the preinjection. It has the same basic design as the pump 42, but its piston 44v has a smaller diameter, because preinjection involves a smaller amount of fuel.

Figure 16:
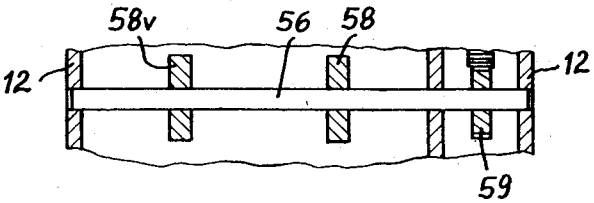
FIG. 16 is a fragmentary sectional view of a portion of the engine of FIG. 15.

The shaft 56 drives both pumps and is itself driven, as illustrated in FIG. 16, by a gear 59 thereon which engages a gear driven by the crankshaft of the engine. The shaft 56 carries the drive cam 58 for the pump 42 and the drive cam 58v for the pump 42v. The drive cam 58 has the four cams 58a, 58b, 58c and 58d, while the drive cam 58v has corresponding cams which are identified with 58va, 58vb, 58vc and 58vd.

The preinjection occurs, in a conventional manner, at approximately 10° of the crankshaft angle of rotation before the main injection. For this reason, the drive cam 58v is mounted on the shaft 56 at a suitable leading angle $\alpha$ with respect to the drive cam 58, as is clearly illustrated in FIG. 17. The pressure line 54v of the pump 42v communicates with the pressure line 54 of the pump 42, which in turn ends in the distributor 62 which was discussed above and from which the four connecting lines 64a, 64b, 64c and 64d lead to the four injection nozzles 66a, 66b, 66c and 66d. Each of these connecting lines is associated with one of the four cylinders 10a, 10b, 10c and 10d.

The control piston 90 (FIG. 5), which is arranged in each injection nozzle and controlled via line 94 by the compression pressure in the operating cylinder of the respective cylinder, requires a finite time period in order to move under the increasing compression pressure from the operating chamber 10aa from the closed or blocking position thereof (FIG. 5) to the open position in which its control groove 90a facilitates fuel flow through the supply line 70. The small amount of preinjection fuel which is conveyed by the preinjection pump 42v can, as soon as the associated cam 58va starts to operate the pump 42v, flow through the line 70 shortly after the start of the opening movement of the piston 90, or in other words before the full opening of the line 70, in order to effect the preinjection. The main injection by the pump 42 occurs shortly thereafter, namely, when the line 70 is fully open and as soon as the cam 58a starts to operate the pump 42. Thus it is inventively possible to carry out both the preinjection and also the main injection through the same injection nozzle.

It would, if desired, also be possible to dimension the width of the control groove 90a on the piston 90 to be slightly larger than in FIG. 5 in order to let the opening of the line 70 start earlier, so that one can adjust the control of this line to particular operating conditions without any difficulties.

The amount of preinjection fuel can be easily adjusted to various engine types. If, during the operation, a proportional increase in the amount of preinjection fuel relative to an increase in the main injection is demanded, one could even couple the control rods 48 and 48v of the two pumps 42 and 42v.

Alternatively, for some engine types it is possible for the amount of preinjection fuel to remain constant during the entire engine operation, so that a control rod for the preinjection pump is not needed.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A multi-cylinder, fuel injection internal combustion engine, comprising: a respective fuel injection valve for each cylinder; a single injection pump which supplies fuel to each of said injection valves and has a movable conveying element, movement of said conveying element effecting movement of fuel through said pump; and a movable drive member which is driven by said engine and which effects movement of said conveying element of said injection pump, said drive member having thereon several driving cams which correspond in number with the number of cylinders of the engine and which in response to movement of said drive member successively engage said conveying element and effect movement thereof; wherein each said injection valve includes an injection nozzle and blocking means for keeping a fuel pressure passage which leads to the injection nozzle closed and for opening said passage only in response to the occurrence of a control condition which occurs at a point in time at which fuel injection is to occur, whereby fuel is conveyed simultaneously to all injection valves by said pump but is injected into the engine through only a respective one of said injection valves in which the blocking means has opened the fuel pressure passage therein in response to the associated control condition; wherein said blocking means of each said injection valve includes a piston supported in the injection valve for movement between two positions in which it respectively permits and obstructs fuel flow through said fuel pressure passage, and a restoring spring which resiliently urges said piston toward one of said positions; wherein each said injection valve includes control means separate from said blocking means for selectively permitting and obstructing fuel flow through said passage and said injection nozzle when the fuel pressure in said fuel pressure passage is respectively above and below a predetermined pressure; wherein said piston is normally in the position in which it keeps said fuel pressure passage closed and is moved to the position in which it permits fuel flow through said passage only in response to the occurrence of said control condition; wherein said control condition for each said injection valve occurs when an inlet valve for the associated cylinder of the engine is in a closed position; wherein said piston of each said injection valve cooperates with a respective follower member which monitors the position of the associated inlet valve through a linkage; wherein when said inlet valve is in an open position said follower member moves said piston to the position in which it closes said fuel pressure passage; and wherein said follower member releases said piston when the associated inlet valve is in its closed position to permit said restoring spring to move said piston to the position in which it permits fuel flow through said fuel pressure passage.

2. The internal combustion engine according to claim 1, wherein said follower member also monitors the position of an outlet valve for the associated cylinder of said engine through a linkage and releases said piston for movement to the position in which it permits fuel flow through said fuel pressure passage only when the inlet valve and outlet valve are each in a closed position.

3. A multi-cylinder, fuel injection internal combustion engine, comprising: a respective fuel injection valve associated with each cylinder and a single injection pump which simultaneously supplies fuel under pressure to all of said injection valves at each point in time at which any of said injection valves is to inject fuel into the associated cylinder; wherein each said injection valve includes an injection nozzle, a fuel pressure passage which leads to said injection nozzle, control means for permitting and obstructing fuel flow from said passage through said nozzle when the pressure in said passage is respectively above and below a predetermined value, and blocking means separate from said control means for respectively permitting and obstructing fuel flow from said pump into said passage in response to the presence or absence of a control condition which occurs at a point in time at which fuel injection is to occur, whereby fuel is conveyed simultaneously to all injection valves by said pump but is injected into the engine through only a respective one of said injection valves in which said blocking means therein has opened said passage therein in response to the associated control condition; wherein said blocking means of each said injection valve includes means defining a cylindrical piston hole within said injection valve, said passage and a line from said pump communicating with said hole at first and second locations which are axially aligned and angularly spaced, a cylindrical piston having a circumferential groove therein and slidably supported in said piston hole for movement between two positions in which said groove is axially aligned with and axially offset from said first location and respectively permits and obstructs fuel flow from said connecting line into said passage through said groove, and resilient means for yieldably urging said piston toward one of said positions; said piston normally being in the position in which it obstructs fuel flow into said fuel pressure passage and being moved to the position in which it permits fuel flow into said passage only in response to the occurrence of said control condition.

4. The internal combustion engine according to claim 3, wherein said resilient means includes a helical compression spring which has an end supported on an end of said piston and urges axial movement of said piston toward the position thereof in which said piston obstructs fluid flow into said passage, including means defining a piston control passageway which provides fluid communication between said piston hole at a location spaced axially from said piston on a side thereof remote from said spring and the interior of the combustion chamber of the associated cylinder, and wherein said control condition occurs when the pressure in the combustion chamber exceeds a predetermined pressure.

5. The internal combustion engine according to claim 3, wherein said resilient means includes a helical compression spring having an end engaging an end of said piston and urging said piston axially toward the position thereof in which it permits fluid flow into said passage, wherein said engine includes a respective inlet valve and a respective outlet valve associated with each said cylinder and movable between open and closed positions, and wherein said blocking means of each said injection valve includes means responsive to the inlet and outlet valves of the associated cylinder for moving said piston against the urging of said spring to the position thereof in which it obstructs fluid flow into said passage when either of the inlet and outlet valves is moved to its open position.

6. The internal combustion engine according to claim 3, wherein each said piston has leakage collecting means therein, said leakage collecting means including a further circumferential groove axially offset from said first-mentioned groove and an axially extending hole which opens through one end of said piston and which communicates with said further groove, said first-mentioned groove being located axially between said end of said piston and said further groove; and wherein each said injection valve includes return line means for conducting fuel away from said leakage collecting means in said piston thereof.

7. The internal combustion engine according to claim 6, wherein said piston hole has threads at each end thereof, wherein said injection valve includes first and second plugs which are each disposed in and threadedly engage a respective end of said piston hole, wherein said end of said piston faces said first plug, wherein said resilient means includes a helical compression spring having one end supported on said first plug and its other end supported on said end of said piston, and wherein said second plug has an axially projecting stop pin thereon which can engage an end of said piston remote from said spring so as to limit axial movement of the piston in a direction toward said second plug under the urging of the spring.

8. A multi-cylinder, fuel injection internal combustion engine, comprising: a respective fuel injection valve for each cylinder; a single injection pump which supplies fuel to each of said injection valves and has a movable conveying element, movement of said conveying element effecting movement of fuel through said pump; and a movable drive member which is driven by said engine and which effects movement of said conveying element of said injection pump, said drive member having thereon several driving cams which correspond in number with the number of cylinders of the engine and which in response to movement of said drive member successively engage said conveying element and effect movement thereof; wherein each said injection valve includes an injection nozzle and blocking means for keeping a fuel pressure passage which leads to the injection nozzle closed and for opening said passage only in response to the occurrence of a control condition which occurs at a point in time at which fuel injection is to occur, whereby fuel is conveyed simultaneously to all injection valves by said pump but is injected into the engine through only a respective one of said injection valves in which the blocking means has opened the fuel pressure passage therein in response to the associated control condition; wherein said blocking means of each said injection valve includes a piston supported in the injection valve for movement between two positions in which it respectively permits and obstructs fuel flow through said fuel pressure passage, and a restoring spring which resiliently urges said piston toward one of said positions; wherein each said injection valve includes control means separate from said blocking means for selectively permitting and obstructing fuel flow through said passage and said injection nozzle when the fuel pressure in said fuel pressure passage is respectively above and below a predetermined pressure; wherein said piston is normally in the position in which it keeps said fuel pressure passage closed and is moved to the position in which it permits fuel flow through said passage only in response to the occurrence of said control condition; and wherein said blocking means of each said injection valve includes a guideway in the valve in which the piston thereof is movably supported and includes leakage return means for guiding fuel which leaks from the fuel pressure passage into the guideway from the guideway to a return passage which leads out of the injection valve.

9. The internal combustion engine according to claim 8, wherein said control condition for each said injection valve occurs when an inlet valve for the associated cylinder of the engine is in a closed position.

10. The internal combustion engine according to claim 8, wherein each said injection valve is elongated in a first direction, and wherein said piston moves in second directions approximately transverse to said first direction.

11. The internal combustion engine according to claim 8, wherein the internal combustion engine includes pre-injection means for effecting a pre-injection of fuel into each cylinder prior to each injection of fuel therein by the associated one of said injection valves, said pre-injection means including a further injection pump which conveys fuel to each of said injection valves.

12. The internal combustion engine according to claim 8, wherein said leakage return means includes said piston having in its periphery a collecting groove which collects leakage fuel from the guideway and having a bore therein which provides fluid communication between the collecting groove and a space in the valve which has said restoring spring therein and which communicates with said return passage.

13. The internal combustion engine according to claim 8, wherein a fuel delivery line from said injector pump is connected to a distributor which is in turn connected by respective supply lines to each of said injection valves.

14. The internal combustion engine according to claim 8, wherein said control condition for each said injection valve occurs when the compression pressure in a combustion chamber of the associated cylinder of the engine exceeds a predetermined value.

15. The internal combustion engine according to claim 14, wherein said blocking means in each said injection valve includes a connecting bore which is provided in the injection valve itself and which provides fluid communication between the associated combustion chamber of the engine and said guideway in which said piston is movably supported.

16. The internal combustion engine according to claim 8, wherein each said injection valve is elongated in a first direction, and wherein said piston moves in second directions approximately parallel to said first direction.

17. The internal combustion engine according to claim 16, wherein said piston is cylindrical and has an axis coaxial with respect to a longitudinal axis of said injection valve.

18. The internal combustion engine according to claim 8, wherein said control condition which determines the injection timing point for each injection valve includes an engine component being in a predetermined position.

19. The internal combustion engine according to claim 18, wherein the position of the engine component determining the injection timing point is sensed by sensor means which, when activated, causes said blocking means to permit fuel flow through said fuel pressure passage.

* * * * *